US010633777B2

(12) United States Patent
Skrippek et al.

(10) Patent No.: US 10,633,777 B2
(45) Date of Patent: Apr. 28, 2020

(54) LAUNDRY-CARE APPLIANCE HAVING A RADIAL FAN

(71) Applicant: BSH Hausgeräte GmbH, München (DE)

(72) Inventors: Jörg Skrippek, Wustermark (DE); Torsten Böttger, Radebeul (DE); Sven Baumgarten, Berlin (DE); Ingo Schulze, Panketal (DE)

(73) Assignee: BSH Hausgeräte GmbH, Munich (DE)

( * ) Notice: Subject to any disclaimer, the term of this patent is extended or adjusted under 35 U.S.C. 154(b) by 11 days.

(21) Appl. No.: 15/570,467

(22) PCT Filed: Apr. 15, 2016

(86) PCT No.: PCT/EP2016/058400
§ 371 (c)(1),
(2) Date: Oct. 30, 2017

(87) PCT Pub. No.: WO2016/177551
PCT Pub. Date: Nov. 10, 2016

(65) Prior Publication Data

US 2018/0148876 A1 May 31, 2018

(30) Foreign Application Priority Data

May 6, 2015 (DE) ..... 10 2015 208 378

(51) Int. Cl.
*D06F 29/00* (2006.01)
*D06F 58/20* (2006.01)
(Continued)

(52) U.S. Cl.
CPC ..... *D06F 29/005* (2013.01); *D06F 39/00* (2013.01); *D06F 58/203* (2013.01); *B08B 3/042* (2013.01); *B08B 2203/005* (2013.01)

(58) Field of Classification Search
CPC ..... D06F 25/00; D06F 29/005; D06F 35/001; D06F 39/00; D06F 58/203;
(Continued)

(56) References Cited

U.S. PATENT DOCUMENTS 2,258,284 A * 10/1941 Findley ..... F04D 17/04 415/204
2009/0074596 A1 3/2009 Qin

FOREIGN PATENT DOCUMENTS

CN 1348031 A 5/2002
CN 2900586 Y 5/2007
(Continued)

OTHER PUBLICATIONS

International Search Report for PCT/EP2016/058400, dated Jul. 18, 2016, 4 pages.
(Continued)

*Primary Examiner* — David G Cormier
(74) *Attorney, Agent, or Firm* — Nixon & Vanderhye P.C.

(57) ABSTRACT

The present invention relates to a laundry-care appliance (100) having a washing tub (107) and a deodorizing module (109) for dispensing deodorizing substance into the washing tub (107), wherein the deodorizing module (109) is connected to the washing tub (107) and comprises a radial fan (115) for ventilating the washing tub (107), wherein the radial fan (115) is drivable in a first direction of rotation (121) and in a second direction of rotation (123). The deodorizing module (109) is configured to dispense deodorizing substance into the washing tub (107) in a first period of time, wherein the radial fan (115) is drivable in the first direction of rotation (121) in the first period of time in order to distribute the deodorizing substance in the washing tub (107). The radial fen (115) is drivable in the second direction of rotation (123) in a second period of time following the first period of time, in order to remove the deodorizing
(Continued)

substance from the washing tub (107) in the second period of time.

15 Claims, 3 Drawing Sheets

(51) Int. Cl.
*D06F 39/00* (2020.01)
*B08B 3/04* (2006.01)

(58) Field of Classification Search
CPC ..... D06F 2232/10; D06F 37/10; D06F 37/18; D06F 37/28; D06F 37/42; D06F 39/14; D06F 49/003; D06F 2212/06; D06F 2224/00
See application file for complete search history.

(56) References Cited

FOREIGN PATENT DOCUMENTS

| | | | |
|---|---|---|---|
| CN | 201039840 | Y | 3/2008 |
| CN | 101460671 | A | 6/2009 |
| CN | 102212957 | A | 10/2011 |
| EP | 1 602 766 | | 12/2005 |
| EP | 1 852 541 | | 11/2007 |
| EP | 1 908 874 | | 4/2008 |
| JP | 2005-192901 | A | 7/2005 |

OTHER PUBLICATIONS

International Preliminary Report on Patentability with amended sheets (non-English), dated Apr. 11, 2017, 21 pages.

* cited by examiner

LAUNDRY-CARE APPLIANCE HAVING A RADIAL FAN

This application is the U.S. national phase of International Application No. PCT/EP2016/058400 filed 15 Apr. 2016, which designated the U.S. and claims priority to DE Patent Application No. 102015208378.0 filed 6 May 2015, the entire contents of each of which are hereby incorporated by reference.

The present invention relates to a laundry care appliance with a radial fan.

During a wash cycle in a laundry care appliance, for example a washing machine, the laundry to be treated is cleaned with wash liquor. In laundry care appliances a deodorizing module can supply deodorizing substance, such as ozone, water mist or fragrance for example, to the washing tub, in order to eliminate or mask unpleasant smelling substances in the laundry in the drum. At the end of the deodorizing treatment the deodorizing substance is removed from the washing tub, which is advantageous for the user in particular when ozone is used, it being potentially harmful to health.

In US 2009/0074596 A1 a pump with a motor is described for mixing ozone and water, in order to dissolve ozone effectively in water and create an ozone/water mixture.

The published patent application EP 1 852 541 A1 shows a tumble dryer comprising a drum. An injector is provided, which can dispense water vapor into the drum. The drum is driven by means of a motor. The motor also drives a fan. A freewheel is provided between the fan and the motor.

It is the object of the invention to specify a laundry care appliance with a deodorizing module, in which the deodorizing substance is removed effectively at the end of the deodorizing operation.

Said object is achieved by subject matter having the features as set out in the independent claims. Advantageous embodiments of the invention are set out in the drawings, description and dependent claims.

According to one aspect of the invention the object is achieved by a laundry care appliance with a washing tub and a deodorizing module for dispensing deodorizing substance to the washing tub, wherein the deodorizing module is connected to the washing tub and comprises a radial fan for ventilating the washing tub, the radial fan being able to be driven in a first rotation direction and in a second rotation direction, the deodorizing module being configured to dispense deodorizing substance to the washing tub in a first time period, the radial fan being able to be driven in the first rotation direction in the first time period, in order to distribute the deodorizing substance in the washing tub, and the radial fan being able to be driven in the second rotation direction in a second time period following the first time period, in order to remove the deodorizing substance from the washing tub in the second time period.

This has the technical advantage that the two different rotation directions of the radial fan allow two air flows of differing intensity to be generated in the washing tub, advantageously allowing the required air flow intensity to be set according to the method step of the deodorizing operation. The laundry care appliance comprises a deodorizing module for dispensing deodorizing substance to the washing tub. Deodorizing substances comprise substances which are administered to the laundry to eliminate odors that are unpleasant to the user of the laundry care appliance. Deodorizing substances can either comprise odor-bearing substances which mask unpleasant odors or can comprise substances which eliminate unpleasant odors either by absorbing or adsorbing the unpleasant smelling substances or by chemical reaction with the unpleasant smelling substances. For example a deodorizing module can comprise an ozone generating element for generating ozone, a mist generating facility for generating water mist or a fragrance dispensing element for dispensing fragrance. Deodorizing can be performed as a separate laundry care process or in combination with a conventional laundry care program.

When one or more deodorizing substances is/are used, it should be ensured that the deodorizing substance is removed from the washing tub again after the deodorizing operation. This prevents the user of the laundry care appliance coming into contact with deodorizing substance that may still be present in the washing tub when removing laundry from the drum. This is particularly important when ozone is used, as ozone in high concentrations can in some instances be harmful to the health of the user. To this end the deodorizing module connected to the washing tub comprises a radial fan, which is configured to generate an air flow which can be fed to the washing tub to ventilate the washing tub.

In the first time period the deodorizing module supplies deodorizing substance and dispenses it to the washing tub in order to eliminate unpleasant smelling substances present in the laundry. It is important here that the radial fan is driven in the first rotation direction and generates a small air flow in the washing tub, which is sufficient to distribute the deodorizing substance in the washing tub. After the unpleasant smelling substances have been eliminated, the deodorizing substance present in the washing tub is removed from the washing tub in a second time period following the first time period. It is important here that the radial fan is driven in the second rotation direction and generates an intensive air flow in the washing tub, which is sufficient to remove the deodorizing substance from the washing tub again.

The radial fan is configured in such a manner that it takes in air along a first axis and emits the air taken in along a second axis, the second axis and the first axis being at a 90° angle to one another, with the result that when the rotation direction of the radial fan changes, the direction of the air flow is not changed, only the intensity of the air flow.

As the geometrical configuration of the radial fan means that the second rotation direction of the radial fan is the preferred rotation direction of the radial fan, the radial fan generates a more intensive air flow in the second rotation direction than in the first rotation direction. It is thus possible to generate air flows of differing intensity just by changing the rotation direction of the radial fan. The air flows of differing intensity are generated by the geometrical configuration of the radial fan and are achieved in particular with an identical supply voltage to the radial fan in the first rotation direction and the second rotation direction. This allows the desired intensity of the air flows in the washing tub to be set precisely, in particular in the case of small volumetric flows.

A laundry care appliance refers to an appliance, which is used to treat laundry, for example a washing machine or tumble dryer. In particular such a laundry care appliance refers to a domestic laundry care appliance, in other words a laundry care appliance used in a domestic situation to treat laundry in normal domestic quantities.

In one advantageous embodiment of the laundry care appliance the laundry care appliance comprises a fan drive for driving the radial fan in the first rotation direction and in the second rotation direction.

This has the technical advantage that the fan drive ensures that the radial fan is driven effectively in the first and second rotation directions. In particular the fan drive can comprise an electric motor, in particular an electric motor operated by direct current.

In one advantageous embodiment of the laundry care appliance the fan drive is arranged outside the deodorizing module and the radial fan is arranged inside the deodorizing module, the radial fan and fan drive being connected by a fan shaft.

This has the technical advantage that the arrangement of the fan drive outside the deodorizing module means that the fan drive is protected from potentially damaging deodorizing substance in the deodorizing module, for example ozone. The fan shaft ensures an effective transmission of force from the fan drive to the radial fan.

In one advantageous embodiment of the laundry care appliance the deodorizing module comprises a module housing, the module housing having an opening and the fan shaft being passed through the opening.

This has the technical advantage that the fan shaft can be passed through the opening of the module housing without friction losses occurring due to contact between the fan shaft and the module housing. The radial fan also generates a negative pressure so that air from outside the deodorizing module flows through the opening into the deodorizing module. The air flow into the deodorizing module in turn prevents deodorizing substance escaping from the deodorizing module so there is no need for a seal in the region of the opening.

In one advantageous embodiment of the laundry care appliance the radial fan comprises a propeller with blades curving forward or backward.

This has the technical advantage that the propeller with its blades curving forward or backward ensures air flows of differing intensity as a function of the rotation direction of the radial fan.

In one advantageous embodiment of the laundry care appliance the deodorizing module comprises an ozone generating element for generating and dispensing ozone to the washing tub, a mist generating facility for generating and dispensing water mist to the washing tub and/or a fragrance dispensing element for dispensing fragrance to the washing tub.

This has the technical advantage that the ozone generating element can supply ozone, the mist generating facility can supply water mist and the fragrance dispensing element can supply fragrance. Ozone is an effective oxidizing agent and is able to deactivate unpleasant smelling substances present in the laundry by means of a chemical reaction. Water mist can eliminate unpleasant smelling substances from the laundry. The fragrance can comprise one or more fragrances which are themselves odor-bearing substances and can mask unpleasant smelling substances in the laundry.

In one advantageous embodiment of the laundry care appliance the deodorizing module is connected to the washing tub by a first connecting line and the washing tub is connected to the deodorizing module by a second connecting line.

This has the technical advantage that the first connecting line ensures an effective supply of deodorizing substance to the washing tub and the second connecting line ensures an effective removal of deodorizing substance from the washing tub. In particular the deodorizing module, the washing tub and the connecting lines can form a closed system.

In one advantageous embodiment of the laundry care appliance the fan drive is configured to drive the radial fan in the first rotation direction and in the second rotation direction with the same supply voltage, the radial fan being configured to generate a first volumetric flow in the first rotation direction, the radial fan being configured to generate a second volumetric flow in the second rotation direction and the second volumetric flow being greater than the first volumetric flow for the same supply voltage.

This has the technical advantage that for the same supply voltage to the fan drive the difference in intensity of the air flows is ensured solely by the geometrical configuration of the radial fan in the first or second rotation direction of the radial fan. For the same supply voltage the geometrical configuration of the radial fan means that the second volumetric flow in the second rotation direction of the radial fan is greater than the first volumetric flow in the first rotation direction. This allows effective adjustment of the volumetric flow to be ensured solely by changing the rotation direction of the radial fan.

In one advantageous embodiment of the laundry care appliance the fan drive is configured to change a rotation speed of the radial fan in the first or second rotation direction in order to change the first or second volumetric flow.

This has the technical advantage that the volumetric flow generated by the radial fan can be effectively fine-tuned by changing the rotation speed of the radial fan and as a result changing the first or second volumetric flow.

In one advantageous embodiment of the laundry care appliance the laundry care appliance comprises a door, a door lock for locking the door, a controller for controlling the door lock and an output detection element for detecting the electrical output of the fan drive, the output detection element being configured to detect a first output value of the fan drive in the first rotation direction of the radial fan and a second output value of the fan drive in the second rotation direction of the radial fan for the same supply voltage, the controller being configured to compare the detected first output value with the detected second output value, in order to determine an output difference, and the controller being configured to deactivate the door lock when the output difference exceeds a threshold value, in particular a threshold value of 20%.

This has the technical advantage that the controller only deactivates the door lock when the function of the radial fan is fully ensured and the deodorizing substance has thus been removed from the washing tub after the second time period in order thus to exclude harm to the user. The radial fan is thus driven with the same supply voltage both in the first rotation direction and in the second rotation direction. The output detection element detects the output value of the fan drive in the first rotation direction and in the second rotation direction respectively, the controller comparing the detected first and second output values with one another in order to determine an output difference. As the radial fan is designed geometrically in such a manner that in the second rotation direction a second volumetric flow is generated which is greater than the first volumetric flow in the first rotation direction, the output difference determined by the controller must be above a defined threshold value, in particular 20%. When the controller determines an output difference above the threshold value, it can be assumed that the radial fan is functioning correctly and the deodorizing substance has therefore been removed effectively from the washing tub in the second time period. The door lock can then be deactivated.

In one advantageous embodiment of the laundry care appliance the output detection element comprises a pressure sensor for detecting an air pressure generated by the radial fan, a current sensor for detecting a supply current to the fan drive or a rotation speed sensor for detecting a rotation speed of the fan drive.

This has the technical advantage that said sensors allow effective detection of the output of the fan drive or in the case of the rotation speed sensor the rotation speed of the fan drive is determined. In the case of a rotation speed sensor the rotation speed of the fan drive is determined by way of the current ripple factor for a radial fan with brushes operated with direct current voltage.

In one advantageous embodiment of the laundry care appliance the laundry care appliance comprises a signal generating facility, the controller being configured to activate the signal generating facility when the output difference is less than the threshold value, in particular less than 20%.

This has the technical advantage that the signal generating facility can transmit a warning, for example warning tone or warning light, to the user of the laundry care appliance when the output difference determined by the controller is less than the threshold value, in particular 20%. When the output difference is less than the threshold value, it is assumed that the radial fan is not functioning correctly and complete removal of the deodorizing substance from the washing tub cannot be ensured.

In one advantageous embodiment of the laundry care appliance the controller is configured only to deactivate the door lock after a time interval when the output difference is less than the threshold value, in particular less than 20%.

This has the technical advantage that when the output difference is less than the threshold value, it is not possible to exclude potential harm to the user due to deodorizing substance still present in the washing tub. The controller only opens the door after a time interval, in order to ensure complete removal of the deodorizing substance from the washing tub.

According to a second aspect of the invention the object is achieved by a method for treating laundry in a laundry care appliance, wherein the laundry care appliance comprises a washing tub and a deodorizing module for dispensing deodorizing substance to the washing tub, wherein the deodorizing module is connected to the washing tub and comprises a radial fan for ventilating the washing tub, the radial fan being able to be driven in a first rotation direction and in a second rotation direction, the method comprising the distribution of the deodorizing substance in the washing tub in a first time period, the radial fan being able to be driven in the first rotation direction in the first time period, and the removal of the deodorizing substance from the washing tub in a second time period following the first time period, the radial fan being able to be driven in the second rotation direction in the second time period.

This has the technical advantage that the differing air flows generated by the different rotation directions of the radial fan ensure effective distribution of the deodorizing substance in the washing tub in a first time period and effective removal of the deodorizing substance from the washing tub in a second time period following the first time period.

In one advantageous embodiment of the method during the distribution of the deodorizing substance in the washing tub or the removal of the deodorizing substance from the washing tub the method also comprises changing a rotation speed of the radial fan in the first or second rotation direction.

This has the technical advantage that the volumetric flow generated by the radial fan is effectively fine-tuned by changing the rotation speed of the radial fan and as a result changing the first or second volumetric flow, resulting in advantageous regulation of the volumetric flow in particular for small volumetric flows.

Further exemplary embodiments are described with reference to the accompanying drawings, in which.

Figure 1:
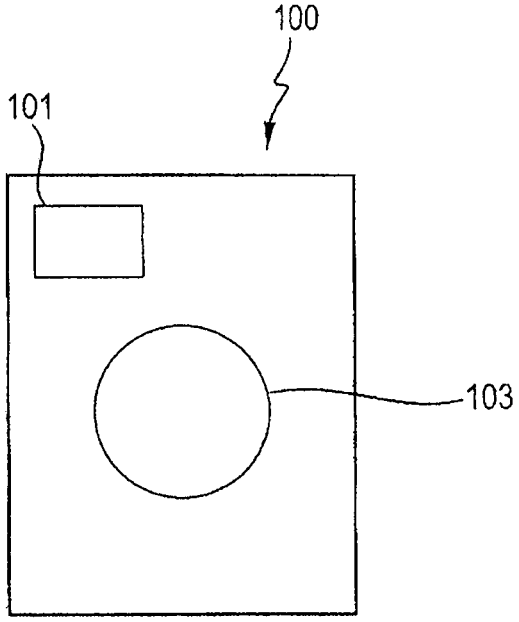
FIG. 1 shows a schematic front view of a laundry care appliance.

FIG. 1 shows a schematic front view of a general laundry care appliance 100, for example a washing machine. The laundry care appliance 100 comprises a detergent tray 101, into which detergent can be introduced. The laundry care appliance 100 comprises a door 103 for loading the laundry care appliance 100 with laundry.

Figure 2:
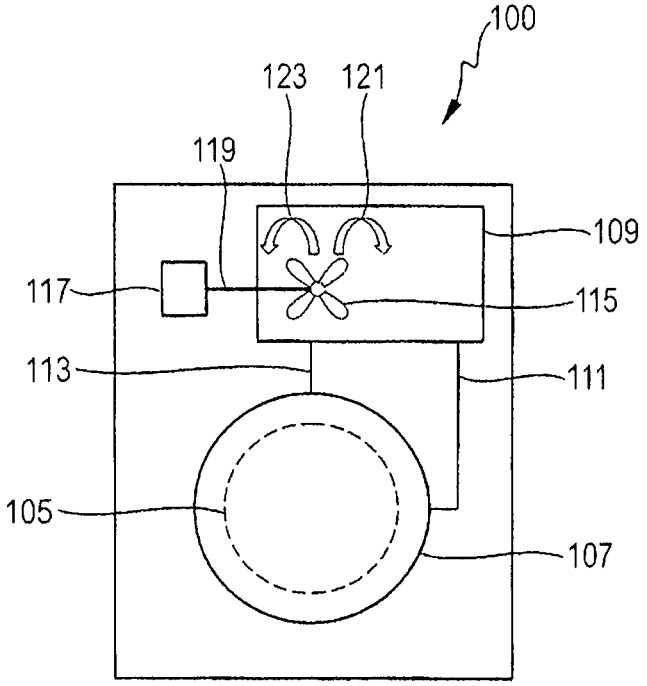
FIG. 2 shows a schematic internal view of a laundry care appliance with a deodorizing module.

FIG. 2 shows a schematic internal view of a laundry care appliance with a deodorizing module. The user can load the drum 105 of the laundry care appliance 100 with laundry by way of the door 103 of the laundry care appliance 100. The drum 105 is arranged in the washing tub 107 of the laundry care appliance 100. Arranged in the laundry care appliance 100 is a deodorizing module 109, which is connected to the washing tub 107 by a first and second connecting line 111, 113. The deodorizing module 109 dispenses deodorizing substance to the line container 107 through the first connecting line 111, it being possible for the deodorizing substance to be removed again from the washing tub 107 through the second connecting line 113. Deodorizing substances comprise substances which are administered to the laundry to eliminate or mask odors that are unpleasant to the user of the laundry care appliance 100. A deodorizing module 109 can comprise an ozone generating element for generating ozone, a mist generating facility for generating water mist or a fragrance dispensing element for dispensing fragrance In order to ensure effective ventilation of the washing tub 107, the laundry care appliance 100 has a radial fan 115, which can be driven by a fan drive 117 by way of a fan shaft 119. The fan drive 117 is arranged in particular outside the deodorizing module 109 in order to be protected from the deodorizing substance in the deodorizing module 109. The radial fan 115 is arranged inside the deodorizing module 109. When the shaft is passed through, it is advantageous to seal the deodorizing module 109 effectively, without however increasing friction resistance due to scraping sealing systems. To this end the passage of the fan shaft 119 is established through the module housing of the deodorizing module 109. There is generally a negative pressure in radial fans as a result. The deodorizing module 109 is intentionally not sealed at the opening, in order to prevent the egress of deodorizing substance from the deodorizing module 109 due to a continuous air flow generated by the negative pressure from outside into the interior of the deodorizing module 109. This has the particular advantage that when the fan shaft 119 is passed through the module housing, friction losses are reduced and manufacturing tolerances of the module housing allow economical manufacture.

A deodorizing process can be carried out in various modes. In the case of a deodorizing module 109 with an ozone generating element and a mist generating facility a distinction should be made between the following modes in particular. During ozone generation and the misting of the laundry the smallest possible volumetric flows of air have to be supplied by the radial fan 115 in order to distribute the deodorizing substances in the washing tub 107 and to maximize the action of the substances. As the ozone breaks down however a maximum volumetric flow should be available so that the deodorizing substance, in particular ozone, is removed effectively from the washing tub 107.

Generally with a radial fan 115 the volumetric flow of the air moved by the radial fan 115 can be changed by changing the rotation speed of the radial fan 115. In the case of small fans operated with direct current in particular the rotation speed adjustment is achieved by changing the voltage, a lower voltage corresponding to a lower rotation speed and a lower volumetric flow and a higher voltage corresponding to a higher rotation speed and a higher volumetric flow. Control of the volumetric flow solely by reducing the rotation speed of a radial fan 115 is however limited, as systemic friction means that it is not possible to drop below certain voltage limits or rotation speed limits.

The requirement for variable volumetric flows can be met particularly advantageously with a radial fan. The radial fan 115 can be driven in a first rotation direction 121 and in a different second rotation direction 123, the radial fan 115 always moving the conveyed air in the same direction in the different rotation directions 121, 123. When the radial fan 115 is driven in the first rotation direction 121, which is counter to the second rotation direction 123, the radial fan 115 generates a much smaller volumetric flow than in the second rotation direction 123 despite the supply voltage being the same. Inversion of the rotation direction 121, 123 therefore corresponds to a switching of the fan characteristic, it being possible to switch between high and low air output with the fan drive 117 at a comparable rotation speed level. As the rotation speed can also be adjusted both in the first rotation direction 121 and the second rotation direction 123 of the radial fan 115, it is possible to set the desired volumetric flow precisely, particularly at low air output.

The breaking down of ozone is a safety-related function in the laundry care appliance 100. The door 103 of the laundry care appliance 100 can only be unlocked when a safe concentration is reached. The door lock of the laundry care appliance 100 must therefore only be deactivated when the quantity of ozone in the washing tub 107 of the laundry care appliance 100 has dropped below a defined ozone value. An ozone breakdown model is used here, the model being used to calculate a time period during which the radial fan 115 has to be driven at a defined rotation speed, until the ozone has dropped below a defined safety-related ozone value. It is assumed here that the measured rotation speed of the fan drive 117 also corresponds to the rotation speed of the radial fan 115. This assumes that the radial fan 115 functions correctly, in other words is fixed to the fan shaft 119 and is not defective.

A method is used here, in which the laundry care appliance 100 comprises a controller and an output detection element for detecting an output value of the radial fan 115 and the following steps are performed. In a first step the radial fan 115 is operated with a defined supply voltage in the first rotation direction 121, the radial fan 115 generating a smaller volumetric flow in the first rotation direction 121 than in the second rotation direction 123. The output detection element here detects at least one output value of the fan drive 117, for example rotation speed of the fan drive 117, the electric current present at the fan drive 117 and/or the air pressure generated by the radial fan 115. When a fan drive 117 with brushes based on direct current is used, the rotation speed of the fan drive 117 can be determined by way of the current ripple factor.

In a second step the radial fan 115 is operated with the voltage defined in the first step in the second rotation direction 123, with a larger volumetric flow being generated in the second rotation direction 123 than in the first rotation direction 121 of the radial fan 115. The output detection element here again detects at least one output value of the fan drive 117.

In a third step the output values detected by the output detection element in the first and second rotation directions 121, 123 are compared by the controller. The differing air conveying properties of the radial fan 115 in the first rotation direction 121 compared with the second rotation direction 123 mean that different output values necessarily have to be detected if the radial fan 115 is functioning correctly. If a comparison of the detected output values shows that the output difference is less than a threshold value, in particular 20%, it should be assumed that the radial fan 115 is malfunctioning. When the radial fan 115 is functioning correctly, the detected output values have to differ by more than a threshold value, in particular 20%.

In a fourth step the target rotation speed of the radial fan 115 is set by increasing the voltage of the fan drive 117 in steps. In this process the output detection element detects at least one output value of the fan drive 117, for example rotation speed, supply current or air pressure, both in the first rotation direction 121 and in the second rotation direction 123 of the radial fan 115, for each step. The smaller the voltage steps, the more precisely the overall characteristic range of the radial pump 115 can be verified.

In a fifth step the controller compares the first and second output values detected at the different time points with corresponding reference output values and determines the deviation from the reference output values. In a sixth step when the target rotation speed has been reached the controller measures the measurement variables cited above continuously and compares the measurement variables with the permissible reference output values.

In a seventh step, if the output values detected by the output detection element and the resulting comparison values are outside the permissible value range, the controller assumes that the function of the radial fan 115 is not ensured. The controller will then only deactivate the door lock at the end of a time interval in order to ensure that the quantity of ozone in the washing tub 107 of the laundry care appliance 100 has dropped to a harmless value. The laundry care appliance 100 can also comprise a signal generating facility, which is configured to display a warning signal to the user.

A corresponding laundry care appliance 100 has the following advantages. The modular structure of the laundry care appliance 100 can be integrated in any laundry care appliance 100. The sensitive parts of the radial fan 115, for example the fan drive 117, are not exposed to the aggressive ozone, thereby increasing service life. The radial fan also ensures a more precise setting range for volumetric flow regulation for the various operating modes, for example ozone generation, misting on the one hand and the breaking down of ozone on the other hand. Two different volumetric flow ranges can also be achieved without a variable voltage supply, simply by inverting the rotation direction of the radial fan 115. Resolution of the settable volumetric flow is also enhanced by rotation speed regulation, allowing very small volumetric flows to be generated.

Figure 3:
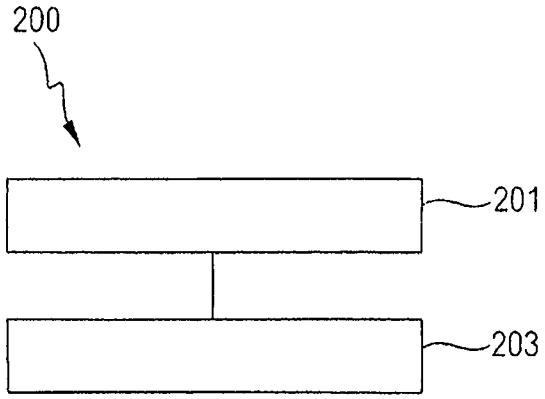
FIG. 3 shows a sequence of a method for treating laundry in a laundry care appliance.

FIG. 3 shows a schematic diagram of a method 200 for treating laundry in a laundry care appliance 100 according to FIG. 1 and FIG. 2, the method 200 comprising the following method steps. Distribution 201 of the deodorizing substance in the washing tub 107 in a first time period, the radial fan 115 being able to be driven in the first rotation direction 121 in the first time period. Removal 203 of the deodorizing substance from the washing tub 107 in a second time period following the first time period, the radial fan 115 being able to be driven in the second rotation direction 123 in the second time period.

During the distribution 201 of the deodorizing substance in the washing tub 107 or the removal 203 of the deodorizing substance from the washing tub 107 the method 200 can also comprise changing a rotation speed of the radial fan 115 in the first or second rotation direction 121, 123.

All the features described and illustrated in conjunction with individual embodiments of the invention can be provided in different combinations in the inventive subject matter, in order to achieve their advantageous effects at the same time.

The scope of protection of the present invention is defined by the claims and is not restricted by the features described in the description or illustrated in the drawings.

LIST OF REFERENCE CHARACTERS

100 Laundry care appliance
101 Detergent tray
103 Door
105 Drum
107 Washing tub
109 Deodorizing module
111 First connecting line
113 Second connecting line
115 Radial fan
117 Fan drive
119 Fan shaft
121 First rotation direction
123 Second rotation direction
200 Method
201 First method step: distribution of the deodorizing substance in the washing tub
203 Second method step: removal of the deodorizing substance from the washing tub

The invention claimed is:

1. A laundry care appliance with a washing tub and a deodorizing module configured to dispense deodorizing substance to the washing tub, wherein the deodorizing module is connected to the washing tub and comprises a radial fan configured to ventilate the washing tub, wherein the radial fan is able to be driven in a first rotation direction and in a second rotation direction, wherein the deodorizing module is configured to dispense deodorizing substance to the washing tub in a first time period, wherein the radial fan is able to be driven in the first rotation direction in the first time period, in order to distribute the deodorizing substance in the washing tub, and the radial fan is able to be driven in the second rotation direction in a second time period following the first time period, in order to remove the deodorizing substance from the washing tub in the second time period, wherein the laundry care appliance further comprises a controller configured to generate a more intensive air flow in the second rotation direction than in the first rotation direction, and wherein the controller is configured to: 1) when the radial fan is driven in the first rotation direction, generate a smaller air flow in the washing tub to distribute the deodorizing substance in the washing tub, and 2) when the radial fan is driven in the second rotation direction, generate an intensive air flow in the washing tub to remove the deodorizing substance from the washing tub, and wherein air flow through the washing tub is in the same direction when the radial fan is rotated in the first and second rotation directions.

2. The laundry care appliance as claimed in claim 1, wherein the laundry care appliance comprises a fan drive controlled by the controller to drive the radial fan in the first rotation direction and in the second rotation direction.

3. The laundry care appliance as claimed in claim 2, wherein the fan drive is arranged outside the deodorizing module and the radial fan is arranged inside the deodorizing module, wherein the radial fan and fan drive are connected by a fan shaft.

4. The laundry care appliance as claimed in claim 3, wherein the deodorizing module comprises a module housing, wherein the module housing has an opening and the fan shaft is passed through the opening.

5. The laundry care appliance as claimed in claim 1, wherein the radial fan comprises a propeller with blades curving forward or backward.

6. The laundry care appliance as claimed in claim 1, wherein the deodorizing module comprises an ozone generator configured to generate and dispense ozone to the washing tub, a mister configured to generate and dispense water mist to the washing tub and/or a fragrance dispenser configured to dispense fragrance to the washing tub.

7. The laundry care appliance as claimed in claim 1, wherein the deodorizing module is connected to the washing tub by a first connecting line and the washing tub is connected to the deodorizing module by a second connecting line.

8. The laundry care appliance as claimed in 2, wherein the fan drive is configured to drive the radial fan with the same supply voltage in the first rotation direction and in the second rotation direction, wherein the radial fan is configured to generate a first volumetric flow in the first rotation direction, wherein the radial fan is configured to generate a second volumetric flow in the second rotation direction and the second volumetric flow is greater than the first volumetric flow for the same supply voltage.

9. The laundry care appliance as claimed in claim 8, wherein the fan drive is configured to change a rotation speed of the radial fan in the first or second rotation direction in order to change the first or second volumetric flow.

10. The laundry care appliance as claimed in claim 8, wherein the laundry care appliance comprises a door, a door lock for locking the door, and an output detector to detect the output of the fan drive, wherein the output detector is configured to detect a first output value of the fan drive in the first rotation direction of the radial fan and a second output value of the fan drive in the second rotation direction of the radial fan for the same supply voltage, wherein the controller is configured to compare the detected first output value with the detected second output value, in order to determine an output difference, and the controller being configured to deactivate the door lock when the output difference exceeds a threshold value.

11. The laundry care appliance as claimed in claim 10, wherein the output detector comprises a pressure sensor configured to detect an air pressure generated by the radial fan, a current sensor configured to detect a supply current to the fan drive or a rotation speed sensor configured to detect a rotation speed of the fan drive.

12. The laundry care appliance as claimed in claim 10, wherein the controller is configured to generate a signal when the output difference is less than the threshold value.

13. The laundry care appliance as claimed in claim 10, wherein the controller is configured only to deactivate the door lock after a time interval when the output difference is less than the threshold value.

14. A method for treating for treating laundry in a laundry care appliance, wherein the laundry care appliance comprises a washing tub and a deodorizing module configured to dispense deodorizing substance to the washing tub, wherein the deodorizing module is connected to the washing tub and comprises a radial fan configured to ventilate the washing tub, wherein the radial fan is able to be driven in a first rotation direction and in a second rotation direction, wherein the method comprises distributing the deodorizing substance in the washing tub in a first time period, wherein the radial fan is able to be driven in the first rotation direction in the first time period, and removing the deodorizing substance from the washing tub in a second time period following the first time period, wherein the radial fan is driven in the second rotation direction in the second time period, wherein a controller is set such that the radial fan generates a more intensive air flow in the second rotation direction than in the first rotation direction, wherein the controller being configured to: 1) when the radial fan is driven in the first rotation direction, generate a smaller air flow in the washing tub, which is sufficient to distribute the deodorizing substance in the washing tub, and 2) when the radial fan is driven in the second rotation direction, generate an intensive air flow in the washing tub, which is sufficient to remove the deodorizing substance from the washing tub, and wherein air flow through the washing tub is in the same direction when the radial fan is rotated in the first and second rotation directions.

15. The method as claimed in claim 14, wherein during the distribution of the deodorizing substance in the washing tub or the removal of the deodorizing substance from the washing tub the method also comprises changing a rotation speed of the radial fan in the first or second rotation direction.

* * * * *